United States Patent [19]

Hicks et al.

[11] 4,128,246

[45] Dec. 5, 1978

[54] CHASE-TYPE BOARD GAME APPARATUS

[75] Inventors: Alan A. Hicks, Chicago; John O. Spinello, Glendale Heights; Jeffrey D. Breslow, Highland Park, all of Ill.

[73] Assignee: Marvin Glass & Associates, Chicago, Ill.

[21] Appl. No.: 767,431

[22] Filed: Feb. 14, 1977

[51] Int. Cl.[2] ..... A63F 3/00

[52] U.S. Cl. ..... 273/243; 221/307; 221/310; 273/148 R; 273/288

[58] Field of Search ..... 273/134 AC, 134 AD, 273/134 GP, 134 BD, 134 ER, 134 AE, 134 C, 134 D, 134 E, 134 B, 134 AT, 144 R, 144 A, 288, 137 R, 137 AB, 148 R, 243, 248; 221/307, 310, 65, 24, 303; 133/5 A

[56] References Cited

U.S. PATENT DOCUMENTS

| | | | |
|---|---|---|---|
| D. 113,535 | 2/1939 | Bradley et al. | 273/134 BD |
| 878,334 | 2/1908 | Bowers | 273/134 D |
| 1,143,210 | 6/1915 | Liljencrantz | 273/134 B |
| 1,879,298 | 9/1932 | Kayser | 221/24 |
| 2,145,394 | 1/1939 | Hobbs et al. | 273/134 AD |
| 2,431,121 | 11/1947 | Hunter | 221/307 |
| 2,520,321 | 8/1950 | McDonald et al. | 133/5 A |
| 2,792,227 | 5/1957 | Auerbach | 273/134 B |
| 3,383,792 | 5/1968 | Goldfarb | 273/144 A |
| 3,392,878 | 7/1968 | Jackson | 221/307 |
| 3,976,219 | 8/1976 | Pagnoni | 221/310 |

FOREIGN PATENT DOCUMENTS

| | | | |
|---|---|---|---|
| 2060900 | 2/1972 | Fed. Rep. of Germany | 221/307 |

*Primary Examiner*—Harland S. Skogquist
*Assistant Examiner*—Harry G. Strappello
*Attorney, Agent, or Firm*—Mason, Kolehmainen, Rathburn & Wyss

[57] ABSTRACT

A board-type game apparatus designed around the theme of a mythical man-animal known as "Big Foot" includes, in combination, a game board having a relatively large playing surface with a plurality of spaced apart playing piece stations or spaces thereon positioned at intervals along a travel path. One of the play spaces is designated as "Big Foot Home". A plurality of relatively small playing pieces are adapted for movement over the playing surface between the spaces along the travel path. One of the playing pieces is formed to resemble the mythical character "Big Foot" and includes a hollow base for containing a plurality of disks adapted to be removably contained in vertically stacked relation therein. Some of the disks have distinguishing indicia on one face, such as a foot print of "Big Foot" and some are plain. The disks are loaded in the hollow base in random order. The "Big Foot" playing piece includes a disk holding member which is releasable upon manual placement of the playing piece into pressure contact against the playing surface of the board to deposit the lower disk in the stack on a playing space when the pressure contact is terminated. A chance device such as a die is used for determining the number of spaces that the playing pieces are moved around the travel path and some playing spaces labeled "card" require the player to draw from a deck of cards provided for the game.

12 Claims, 8 Drawing Figures

| PROTECTION FROM BIG FOOT 44 | MOVE BIG FOOT 5 SPACES 46 | MOVE ANY TOKEN TO NORTH PASS 48 |
|---|---|---|

CHASE-TYPE BOARD GAME APPARATUS

BACKGROUND OF THE INVENTION

1. Field of the Invention

The present invention relates to a board game apparatus and more particularly to a board game having a novel playing piece with mechanism for use in movement of the playing piece between spaces on a travel path of the game board.

2. Brief Description of the Prior Art

Board games are well known and have enjoyed a great deal of popularity. Many conventional board games include a plurality of playing pieces, usually one or more for each player of the game, and a game board having a plurality of playing stations or spaces defining a playing piece path of travel. Often one or more chance devices are integrated into the games for determining the amount of advancement or movement of the playing pieces around the game board travel path. As the playing pieces are advanced around the path landing on various playing stations, the players are directed to act in accordance with the game rules and sometimes the rules or action is indicated by the indicia printed on the playing spaces along the travel path.

In the present invention, means are provided for randomly modifying the indicia on the playing stations by depositing randomly oriented disks thereon and these disks are originally contained in one of the playing pieces of the game.

It is an object of the invention to provide a new and improved game board apparatus of the character described.

More particularly it is an object of the present invention to provide a new and improved board-type game apparatus wherein one of the playing pieces is adapted to hold a plurality of disks, some having indicia on at least one face thereof and other being plain. The disks are randomly stacked within the playing piece for controlled deposit on the game board as the playing piece is moved about.

Yet another object of the present invention is to provide a new and improved game board-type apparatus wherein the printed indicia for controlling the action of the players includes both fixed indicia on the game board, plus movable indicia which are placed at various playing stations along the travel path during the game by one of the playing pieces.

Yet another object of the present invention is to provide a new and improved game board-type apparatus developed along the theme of a fictional man-animal character known as "Big Foot".

Another object of the invention is to provide a new and improved board-type game apparatus of the character described wherein one of the playing pieces is moved in attempt to capture the other playing pieces with the last playing piece to remain free of capture being the winner of the game.

SUMMARY OF THE INVENTION

The foregoing and other objects and advantages of the present invention are accomplished in a new and improved board-type game apparatus comprising in combination, a game board having a relatively large playing surface with a plurality of spaced apart stations or spaces thereon at intervals along a playing piece travel path. A plurality of relatively small playing pieces are used by the players for movement around the playing surface between the spaces along the travel path. One of the playing pieces is designed in the likeness of the mythical man-animal named "Big Foot" and includes a hollow base for containing a plurality of disks adapted to be removably contained in stacked relation there-in. Some of the disks have distinguishing indicia such as a foot print of "Big Foot" on at least one face thereof and others are plain. The disks are manually loaded in the hollow base in random order before play begins. Holding means is provided on the Big Foot playing piece which is releasable on manual pressure applied to the base against the playing surface for depositing the lowest disk in the stack on the game board. If the playing piece or token of any player lands on one of the disks having the indicia thereon, the player then operates a chance device such as a die or pair of die and is required to move the Big Foot playing piece for the particular number of spaces indicated by the die to attempt to capture the other players. A deck of cards is also provided to direct additional playing piece moves and the game is continued until only one player having a token or playing piece remains in the game.

BRIEF DESCRIPTION OF THE DRAWINGS

For better understanding of the invention, reference should be had to the following detailed description taken in conjunction with the drawings, in which.

DESCRIPTION OF THE PREFERRED EMBODIMENT

Figures 1, 2:
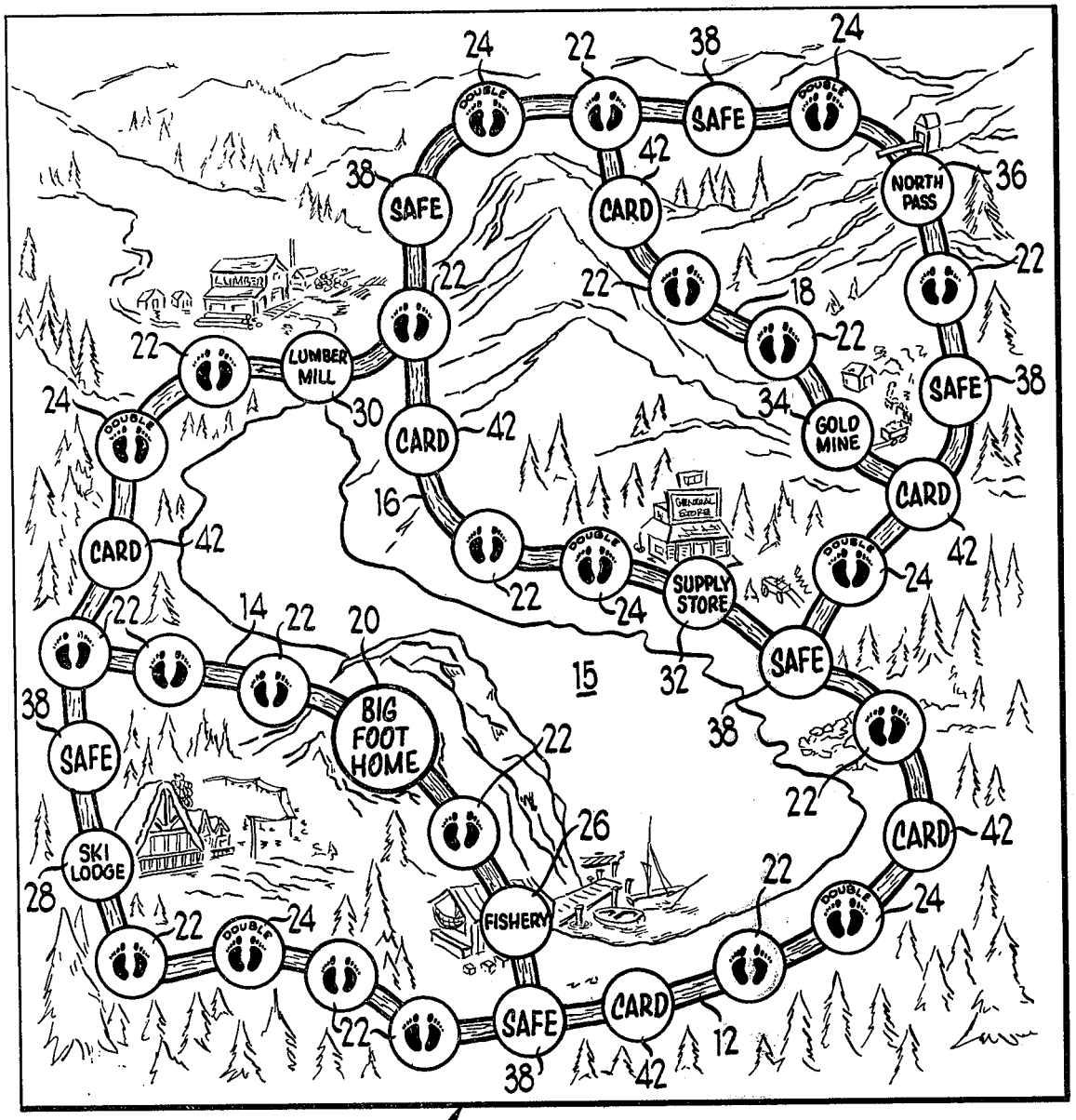
FIG. 1 is a top plan view of the playing surface of a game board constructed in accordance with the features of the present invention.
FIG. 2 illustrates the playing faces of several types of cards provided in a deck of cards used in conjunction with the game board.
Figure 3:
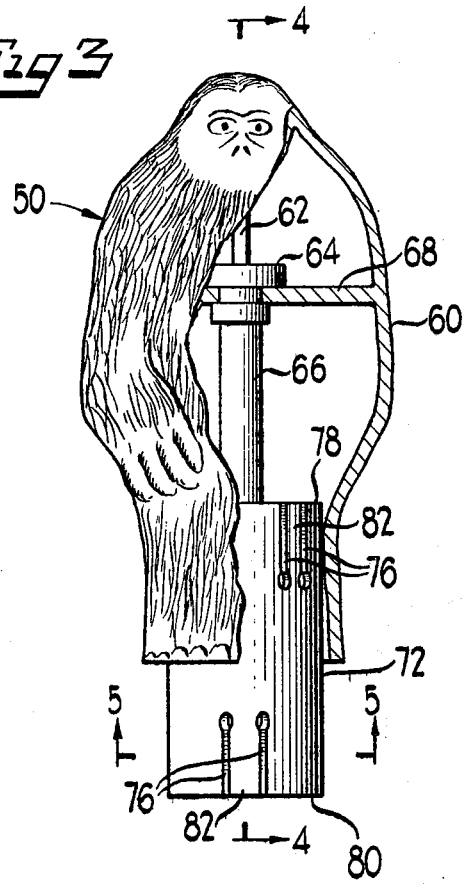
FIG. 3 is a front elevational view, with portions cut away and in section, illustrating one of the playing pieces in accordance with the present invention.

Referring now more particularly to the drawings, in FIG. 1 is illustrated the playing face of a game board 10 in accordance with the features of the present invention. The playing face of the game board is designed and artistically rendered around the theme of the mythical man-animal character known as "Big Foot" who purportedly inhabites some of the highest altitude portions of the world on the continent of Asia in the Himalayan Mountains. The Big Foot character according to legend is supposed to be part man and part ape and of great size and physical strength, so as to strike fear and terror in the hearts of the people inhabiting the area where Big Foot reportedly roams around. Accordingly, the theme of the game is developed around this idea and each player attempts to avoid capture by Big Foot and as will be developed later, each player attempts to move Big Foot around the game board to capture the tokens of other players, with the last remaining player surviving without capture, being the winner of the game.

The playing surface of the game board 10 includes an irregular outer travel path 12 forming an outer peripheral loop around the game board and several intermediate branch paths 14, 16 and 18 are provided to interconnect segments of the outer loop. The branch path 14 is provided with a relatively large, playing piece or space station 20 which is labeled "Big Foot Home" and this space is the starting space for a playing piece which is fashioned to resemble Big Foot and which will be described in more detail hereinafter. Additional smaller circular playing stations or spaces 22 are provided at intervals along the various travel paths and these spaces show a pair of foot prints of Big Foot and are hereinafter referred to as "Big Foot Spaces". In addition, several circular playing stations or spaces 24 are provided at random locations around the travel path and these spaces in addition to the foot print markings having the wording "Double" thereon. The spaces 24 are hereinafter referred to as "Double Big Foot Spaces".

On the branch path 14 below Big Foot Home station 20, there is provided a circular playing space 26 labeled "Fishery" 26 and a fishing area is depicted nearby on the game board positioned at the lower end of a lake 15 which is located between the branch paths 14 and 16.

Similarly, a circular playing space 28 is labeled "Ski Lodge" and a Ski Lodge is illustrated adjacent to this station as shown. At another point on the outer travel path 12 there is provided a circular playing station 30 labeled "Lumber Mill" and a Lumber Mill is depicted adjacent to this space and is located on a stream which flows downwardly to feed into the upper end of the lake 15. On the intermediate branch path 16 there is provided a circular playing station 32 labeled "Supply Store" and a Supply Store is depicted in the vicinity above this space. On the upper branch path 18 another circular playing station 34 is labeled "Gold Mine" and a Gold Mine is depicted on the game board in the immediate vicinity of this space. In the upper right hand corner portion of the playing board 10 another circular playing station 36 is provided and this station is labeled "North Pass" with a toll house being depicted nearby. The playing stations 26, 28, 30, 32, 34 and 36 and the pictures on the board nearby, representing geographical spaces or stations and add to the theme of the game which is built around the central character of Big Foot.

The travel path is also provided with a plurality of circular stations 38 which are labeled "Safe" and when a player's token is positioned on one of these stations the player is immune from capture by Big Foot. In addition to the playing stations or spaces described, the travel path is provided with a plurality of circular playing stations 42 labeled "Card" and a player landing on one of these stations is obliged to draw a card 44, 46 or 48 from a stack of cards which are first shuffled and then placed face down in a stack conveniently adjacent the game board during play. The cards 44 include a playing face with the words "Protection From Big Foot" printed thereon and these cards in possession of a player prevent the player's token from being captured and eliminated from the game should the Big Foot playing piece land on a space being occupied by the token. When a player draws a card 46 which contains the indicia "Move Big Foot Five Spaces", he is obliged to move Big Foot five playing spaces along the travel path and when doing so, he will move Big Foot in a direction best designed to capture or land on a space or spaces occupied by the tokens of the other players. The number of spaces that Big Foot is to be moved, may be varied on the cards 46. The cards 48 bear on their playing face, the indicia "Move Any Token to North Pass" which is represented by the playing space or station 36 on the outer travel path 12. Similarly, other cards 48 may direct movement of the player's tokens to other geographic spaces such as the Fishery 26, the Ski Lodge 28, the Lumber Mill 30, the Supply Store 32, the Gold Mine 34 or the Big Foot Home 20. Any player drawing a card 48 can them require any other player to move his playing token to the geographis space indicated on the card that is drawn.

In accordance with the present invention, the board game apparatus includes a number of playing pieces for movement around the travel paths 12, 14, 16 and 18 on the game board 10 between the various spaces or playing stations as described. These playing pieces include a Big Foot playing piece 50 (FIGS. 3 through 6) and a plurality of players' tokens 52, 54 and 56, at least one of which is provided for each of the players in the game. These tokens may be provided with identifying means such as different colors or printed indicia thereon to distinguish one token from another. A chance device such as a conventional die 58 or pair of die. is provided for determining the number of spaces along the travel path that the playing pieces 50, 52, 54 and 56 will be advanced each turn.

The Big Foot playing piece 50 includes an upper hollow body portion 60 having an outer surface shaped and decorated to represent the mythical man-animal creature known as Big Foot who is thought to inhabit the Himalayan Mountain regions in Asia. The body is preferably formed of integrally molded plastic material and includes a vertical stiffening rib 62 having a lower end surface bearing downwardly against the upper head portion 64 of a depending, centrally positioned rod element 66. The head portion of the rod element is seated and retained in a circular opening formed in a horizontal stiffening web 68 in the interior of the hollow body. At the lower end, the rod element 66 is formed with an integrally circular foot 70 having beveled upper and lower peripheral surfaces and adapted to seat within a cylindrical base or casing 72 which supports the Big Foot playing piece on the game board 10. Preferably, the base 72 is formed of molded plastic material and has an outer diameter slightly less than the inside diameter of the lower portion of the upper body 60 so that the upper portion of the base is slidably received within the body.

Figure 4:
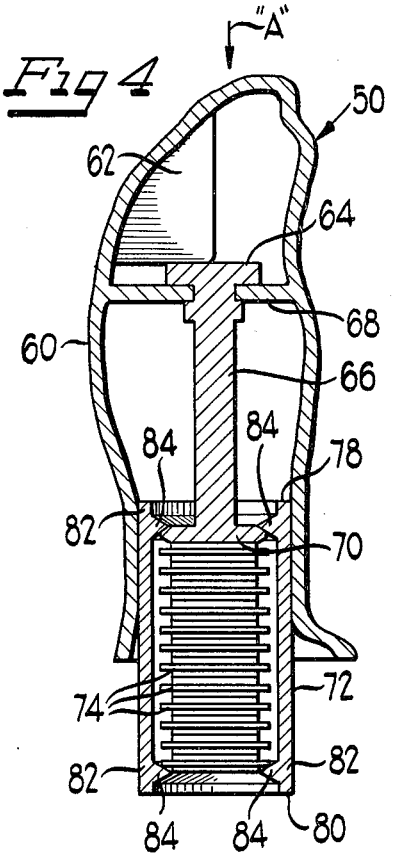
FIG. 4 is a vertical cross-sectional view taken substantially along lines 4—4 of FIG. 3.
Figure 6:
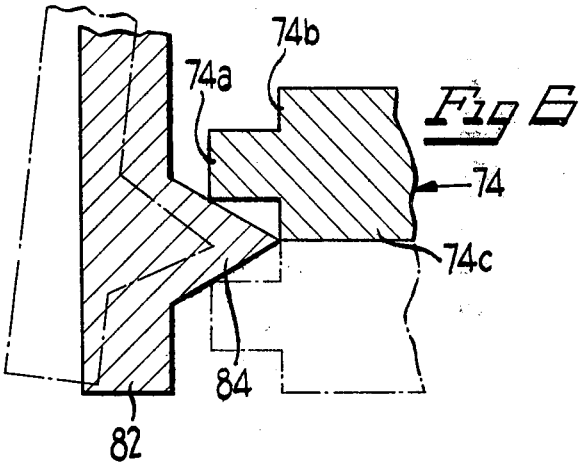
FIG. 6 is a greatly enlarged, fragmentary, vertical sectional view of a lower portion of the playing piece of FIG. 3, taken along the lines 4—4 thereof, and indicating in dotted lines another operational position of the disk holding means for release of a disk.
Figure 7:
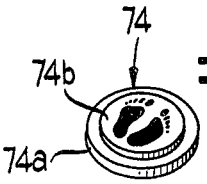
FIG. 7 is a perspective view of one of the disks used in the game and showing the indicia on a face thereof.
Figure 8:
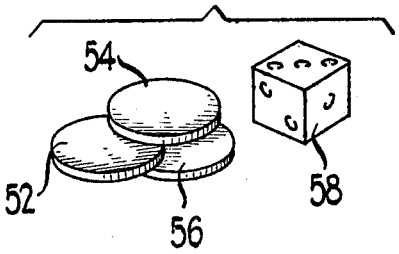
FIG. 8 is a composite, perspective view of additional playing pieces or tokens and a die used by the players in the game.

The base is formed with a vertical bore extending between the upper and lower end and this bore is dimensioned to contain a plurality of circular shape disks 74 which are arranged into a vertical stack and loaded into the base as best shown in FIG. 4. The disks are formed with an intermediate or middle portion **74*a* which is slightly larger in diameter than an upper segment 74*b* and a lower segment 74*c* as shown in FIGS. 6 and 7. In general, the diameter of the disks 74 is similar to that of the tokens 52, 54 and 56 and is generally the same or smaller than the diameter of the circular playing spaces on the game board 10. The cylindrical sleeve or base 72 is formed with several pairs of spaced apart, longitudinal extending slots or slits 76 which project vertically from annular upper and lower end surfaces 78** and 80, respectively. Each pair of the longitudinal slits defines a deflectable segment or finger 82 therebetween having an integrally formed tooth-like pawl 84 on the inside surface adjacent the free end. Because of the relatively narrow width of the fingers 82, they are deflectable outwardly to the position shown in dotted lines in FIG. 6 by downward pressure of the disks contained in the base. When sufficient downward pressure is applied, the lower most disk in the stack cams the fingers outwardly and is then released to drop out of the hollow base 72 onto the game board 10. After a disk is released, the deflectable fingers 82 snap back to the normal or vertical position (solid lines) wherein the upper surface of their pawls 84 engage and hold the stack of disks within the cylindrical hollow bore of the base 72. When downward manual pressure is exerted on the upper body 60 of the Big Foot playing piece 50, as shown by the arrow "A" in FIG. 4, the foot 70 biases the stack of disks downwardly and when the pressure is great enough, the lower fingers 82 are deflected outwardly to release the lowermost disk 74 in the stack. When the downward pressure between the lower end surface 80 of the base 72 and the surface of the game board 10 is controlled by the manipulation of the playing piece and when the playing hand is removed or the playing piece is picked up the fingers 82 spring back inwardly so that the pawls 84 again are positioned to retain the stack of disks within the hollow base. Downward force from the upper body portion 60 of the playing piece is transmitted to the stack of the disks 74 by the lower foot 70 on the central rod 66 within the base 72. This lower foot 70 engages the pawls 84 on the upper fingers 82 to retain the base 72 and the disks 74 contained therein within the playing piece body 60 when Big Foot is lifted for movement around the game board.

Some of the disks 74 are provided with indicia on the upper and lower faces or at least one face thereof, representing a pair of foot prints similar to the foot prints shown on the Big Foot spaces 22 of the game board. These disks are hereinafter referred to as Big Foot or printed disks and others of the disks do not contain any indicia thereon and these disks are referred to as "unprinted disks". The printed and unprinted disks are randomly ordered in the stack of disks contained in the base of the Big Foot playing piece 50 so that as the playing piece is moved about the game board, printed and unprinted disks will be deposited in a random order. In addition, the Big Foot playing piece 50 may be moved around with little or no pressure applied between the lower surface 80 of the base 72 and the game board, and when this is done, no disks will be dispensed as the lower disk holding fingers and pawls are not deflected outwardly far enough to release the lowest disk in the stack.

The amount of pressure exerted between the lower end 80 of the disk containing base 72 and the game board surface is dependent upon the amount of downward force exerted on the upper body 60 of the playing piece and this is readily controlled to selectively dispense the disks 74 only on the spaces desired during movement. For example, if Big Foot is placed lightly to rest on or touch the game board, no disk will be deposited. To cause a disk to be dispensed, enough pressure must be applied on the play piece body 60 to deflect the fingers 82 outwardly enough so that the pawl teeth 84 clear the outer diameter middle portion 74*a* of the lowest disks contained.

Figure 5:
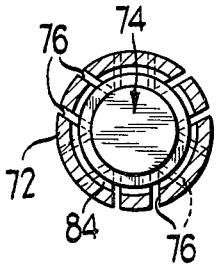
FIG. 5 is a horizontal cross-sectional view taken substantially along lines 5—5 of FIG. 3.

As illustrated in FIG. 5, the pairs of vertical slots 76 which define the deflectable fingers 82 may be equilaterally spaced around the exterior of the support base 72 so that the disks contained in the base are more or less evenly supported around their circumference. As subsequent disks are ejected from the base in the manner described, the upper body portion 60 of the Big Foot playing piece moves downwardly on the base or conversely the base extends further upwardly into the interior of the lower portion of the upper body. When the lower surface 80 of the base 72 reaches a level adjacent the lower end surface of the upper body 60, additional disks 74 are then loaded into the base 72 in a randomly ordered stack.

In accordance with the invention, the game is played by two or more players, each player having one or more of the tokens 52, 54, 56 etc. Initially, the Big Foot playing piece 50 is placed on the playing space 20 denoting Big Foot Home. Each player, in rotation, throws the die 58 and the highest roller has the first turn to place his tokens on the board. The tokens must be placed on one of the Big Foot spaces 22 and normally they are placed on spaces which are the farthest away from the Big Foot playing piece 50. After all of the players have placed their tokens on the Big Foot spaces 22 as described, play is started by the highest rolling player who again rolls the die. After the roll, he must move any one of his tokens the prescribed number of spaces represented on the die face. The move can be in any one direction and at the end the token must land on an unoccupied space. If a player cannot end his move on an unoccupied space, he must skip a turn. A player cannot travel around Big Foot as Big Foot is considered an obstacle which closes the path to traffic by the token. When any player's token lands on a Big Foot space 22 at the end of a move, the player is required to roll the die again and then is required to move Big Foot the required number of spaces as indicated by the die. When moving Big Foot along the travel path, the player is required to press down and eject a disk 74 on any spaces which are occupied by tokens of the opposition players. If a foot print or a printed disk 74 is ejected on the token of a player, the token is considered to be captured and is removed from the game. If an unprinted disk 74 is ejected, a player's token remains safe and is still in play. If any player lands on a double Big Foot space 24 at the end of hiw regular move, he will again roll the die and should move Big Foot an amount of spaces that is double the number that appears on the die face. Big Foot must be moved in any one direction and if Big Foot comes to rest on a token but does not dispense a printed disk 74, the token remains in the game and is moved normally when it becomes the players turn to move without interference from Big Foot. The Big Foot playing piece can be loaded up with additional disks 74 from time-to-time but only by the person who is moving Big Foot when the last disk in the stack is ejected.

Should a player land on a card space, he then draws a card from the stack but cannot play the card until the beginning of his next turn. One exception of this rule is the drawing of a card 44 which provides protection from Big Foot and this type of card can be played at any time to prevent a capture by Big Foot from taking place. Any number of cards may be placed in succession on a single turn.

Any player landing on a Safe space is safe from a Big Foot printed disk and the winner of the game is the last remaining player having a token to tokens left on the board.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. In a board-type game apparatus, in combination:

a game board having a relatively large playing surface with a plurality of spaced apart stations thereon positioned at intervals along a travel path, and a plurality of relatively small playing pieces adapted for movement over said playing surface between said stations along said travel path, one of said playing pieces having an upper body having an opening in a lower end and a hollow base slidably disposed in said opening, said hollow base accommodating a plurality of disks adapted to be removably contained in vertically stacked relation therein, some of said disks having distinguishing indicia on at least one face thereof and manually loadable in said hollow base in a stack with said faces randomly ordered, said one playing piece including holding means releasable upon manual placement of said base in pressure contact against said playing surface for releasing a lowest one of said stacked disks from said hollow base to remain on said playing surface when said pressure contact is terminated and said upper body including means engageable with an upper disk in said stack for biasing a lower disk therein against said holding means for release thereof.

2. The apparatus of claim 1 including a chance device for indicating the number of spaces of movement of said playing pieces around said travel path.

3. The apparatus of claim 2 wherein at least one of said stations on said travel path bears indicia requiring a player to take action involving a second chance selection device and a second chance selection device comprising a deck of cards, some of said cards bearing indicia requiring movement of at least one of said playing pieces around said path.

4. The apparatus of claim 3 wherein at least some of said cards bear indicia requiring the movement of said one playing piece around said path.

5. The apparatus of claim 2 wherein said holding means on said one playing piece is manually controllable to release or retain a lowest disk in the stack contained therein dependent upon the amount of said pressure contact.

6. A playing piece for manipulation on the playing surface of a board game apparatus and adapted to dispense disks thereon comprising:

a hollow body having an opening adjacent a lower end portion thereof and a hollow support base slidably disposed in said opening, said hollow body including means extending downwardly into said hollow base engageable with an upper disk in a stack of disks releasably contained in said hollow base for exerting downward force thereon to release said lower disk for deposit on said board of said apparatus, and holding means on said base for retaining a lower disk in said stack and releasable in response to pressure exerted on said lower disk permitting said disk to be released from said support base, said holding means comprising at least one deflectable finger on said hollow support base including pawl means normally engaging said lower disk to retain the same in said stack and deflectable outwardly by pressure exerted by said disk to release the same from the base.

7. The apparatus of claim 6 wherein said base comprises a hollow tube open at both ends and said finger is formed by a wall portion of said tube between a pair of longitudinal slits extending from one of said ends.

8. The apparatus of claim 7 wherein said pawl is formed on an inside surface of said finger adjacent said one end.

9. The apparatus of claim 8 wherein said pawl comprises a pointed tooth having a sloping upper surface engaging said lower disk in stack.

10. The apparatus of claim 9 including a plurality of said fingers on said hollow base at both of said ends and equilaterally spaced around said hollow tube.

11. The apparatus of claim 10 wherein said hollow body includes an element extending downwardly into an upper end portion of said hollow tube and means on said element engaging the pawls on said fingers adjacent the upper end of said base for retaining said base in said opening in said hollow body.

12. The apparatus of claim 11 wherein said last mentioned means includes a disk on said element engaging an upper disk in said stack for biasing the stack downwardly to eject a lower disk upon outward deflection of said fingers at the lower end of said base.

* * * * *